US008474509B2

(12) United States Patent
Koop

(10) Patent No.: US 8,474,509 B2
(45) Date of Patent: Jul. 2, 2013

(54) OPERATING SYSTEM FOR AN ARCHITECTURAL COVERING

(75) Inventor: Lars Koop, Bremerhaven (DE)

(73) Assignee: Hunter Douglas Industries BV, Rotterdam (NL)

( * ) Notice: Subject to any disclaimer, the term of this patent is extended or adjusted under 35 U.S.C. 154(b) by 834 days.

(21) Appl. No.: 12/530,025

(22) PCT Filed: Mar. 4, 2008

(86) PCT No.: PCT/EP2008/001711

§ 371 (c)(1), (2), (4) Date: Dec. 18, 2009

(87) PCT Pub. No.: WO2008/110286

PCT Pub. Date: Sep. 18, 2008

(65) Prior Publication Data

US 2010/0101741 A1 Apr. 29, 2010

(30) Foreign Application Priority Data

Mar. 9, 2007 (EP) ..... 07004875

(51) Int. Cl.
*E06B 9/56* (2006.01)

(52) U.S. Cl.
USPC ..... 160/321; 160/291; 160/293.1

(58) Field of Classification Search
USPC ..... 160/321, 293.1, 291, 307; 474/203, 474/154
See application file for complete search history.

(56) References Cited

U.S. PATENT DOCUMENTS

| | | | | |
|---|---|---|---|---|
| 2,564,831 | A * | 8/1951 | Butkus | 188/65.1 |
| 2,577,046 | A * | 12/1951 | Bennett | 160/321 |
| 4,884,618 | A * | 12/1989 | Steeves | 160/321 |
| 6,164,428 | A * | 12/2000 | Berman et al. | 192/223.4 |
| 6,250,359 | B1 * | 6/2001 | Lorio et al. | 160/178.1 V |
| 6,685,592 | B2 * | 2/2004 | Fraczek et al. | 475/14 |
| 7,353,847 | B2 * | 4/2008 | Early | 141/9 |
| 2006/0243402 | A1 * | 11/2006 | Chang | 160/321 |
| 2010/0101741 | A1 * | 4/2010 | Koop | 160/321 |
| 2011/0168339 | A1 * | 7/2011 | Bowen et al. | 160/268.1 |

FOREIGN PATENT DOCUMENTS

EP 1 672 164 A 6/2006

* cited by examiner

*Primary Examiner* — Blair M. Johnson
(74) *Attorney, Agent, or Firm* — Dorsey & Whitney LLP

(57) ABSTRACT

Operating system (1) for rotatably controlling retraction and deployment of an architectural covering. The operating system includes a drive pulley wheel (3) having a circumferential rim (5), a length of looped drive cord (9) operatively engaged with the pulley wheel (3) about its circumferential rim (5) and having depending portions on opposite sides of the pulley wheel (3), a cover (7) co-extensive with a portion of the circumference of the pulley wheel (3) and at least one stopper (19) attached to a portion of the length of the drive cord (9) and adapted to engage the cover (7) to stop rotation upon a predetermined amount of rotation of the pulley wheel (3). The pulley wheel is provided with a cavity (17) on its toothed circumference for receiving the at least one stopper (19) to prevent it from engaging the cover (7).

19 Claims, 8 Drawing Sheets

OPERATING SYSTEM FOR AN ARCHITECTURAL COVERING

The present invention relates to an operating system for an architectural covering. More in particular it relates to an operating system for rotatably controlling retraction and deployment of an architectural covering having at least one windable element.

In such operating systems it is often useful to have an end stop to limit the extent of maximum deployment, the full retracted position, or both. To this end EP1672164 proposes a stopper that can be attached to a portion of the length of a looped drive cord, such as a ball chain. The stopper when it engages a cover surrounding a portion of a drive pulley—with which it is operatively engaged—will block further rotation of the pulley wheel. If one stopper is used the looped drive cord should at least have a length that is at least a sufficient multiple of the pulley circumference to accord with the number of turns required to move the architectural covering between its fully retracted and fully deployed positions. The required length of looped drive cord is usually not a problem when the pulley wheel drives the architectural covering directly, but it can become problematic when the drive uses a reduction gearing. Reduction gearings, such as disclosed by U.S. Pat. No. 6,685,592, have become popular for heavier roller blinds and the required number of rotations of the pulley wheel is usually 1.75 to 2.00 times the rotation of a winding means for retracting and deploying of the architectural covering. This can, in some situation, give rise to impractically long drive loops that can present a safety hazard.

Hence the present invention seeks to solve the problem of excessively long drive cord loops, especially in combination with the use of reduction gearing. It is also an object of the present invention to provide alternative structures which are less cumbersome in assembly and operation and which moreover can be made relatively inexpensively. Alternatively it is an object of the invention to at least provide the public with a useful choice.

In accordance with the present invention there is provided an operating system for rotatably controlling retraction and deployment of an architectural covering, the operating system including:

- a drive pulley wheel having a circumferential rim;
- a length of looped drive cord operatively engaged with the pulley wheel about its circumferential rim and having depending portions on opposite sides of the pulley wheel;
- a cover co-extensive with a portion of the circumference of the pulley wheel; and
- at least one stopper attached to a portion of the length of the drive cord and adapted to engage the cover to stop rotation upon a predetermined amount of rotation of the pulley wheel, wherein the pulley wheel is provided with a cavity on its toothed circumference, for receiving the at least one stopper to prevent it from engaging the housing.

Further objectives, features and advantages of the invention will become apparent in view of the following detailed description of a preferred embodiment in conjunction with the accompanying drawings in which.

Figure 1:
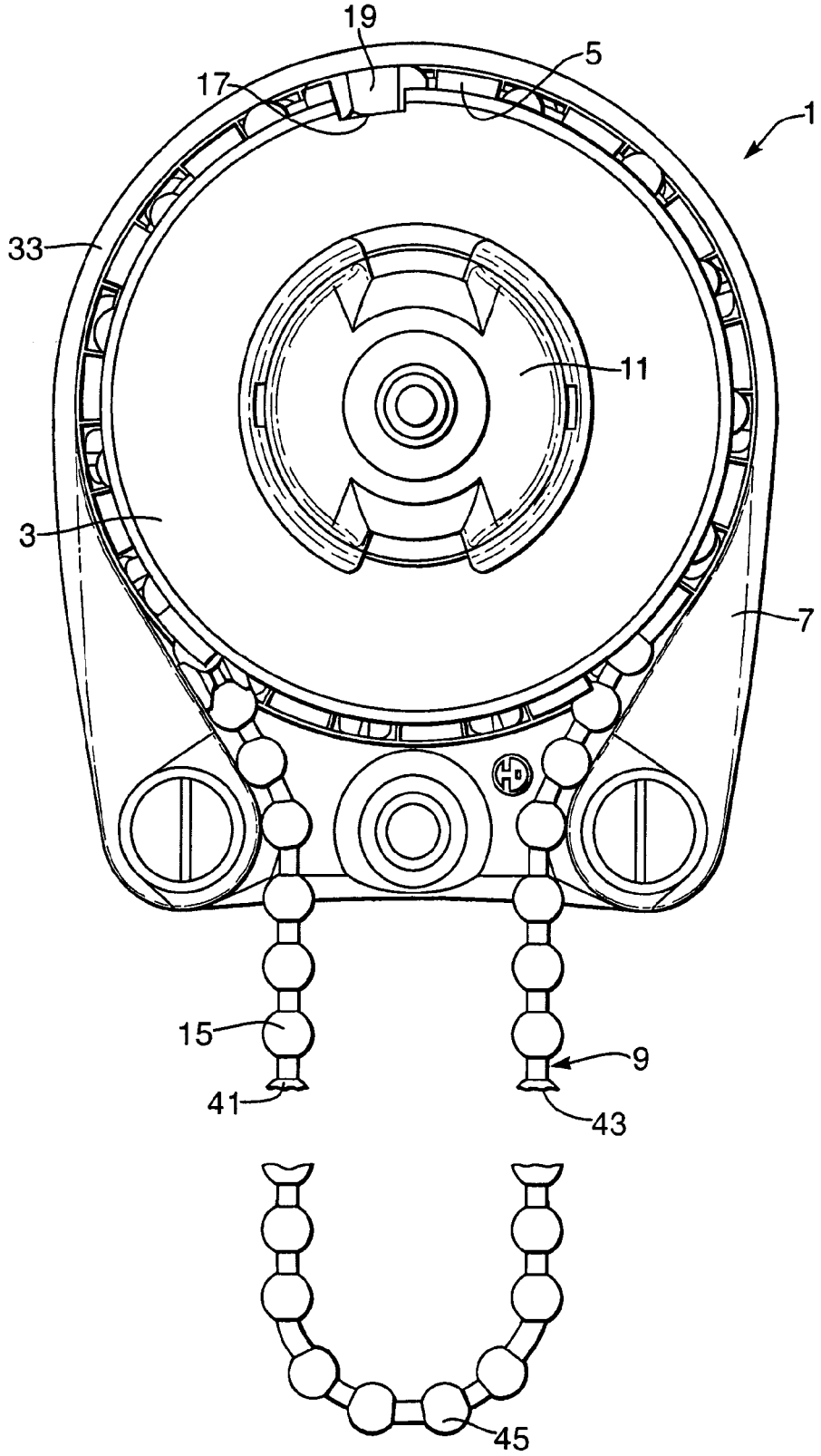
FIG. 1 is an end elevation of an operating system according to the present invention.
Figure 2:
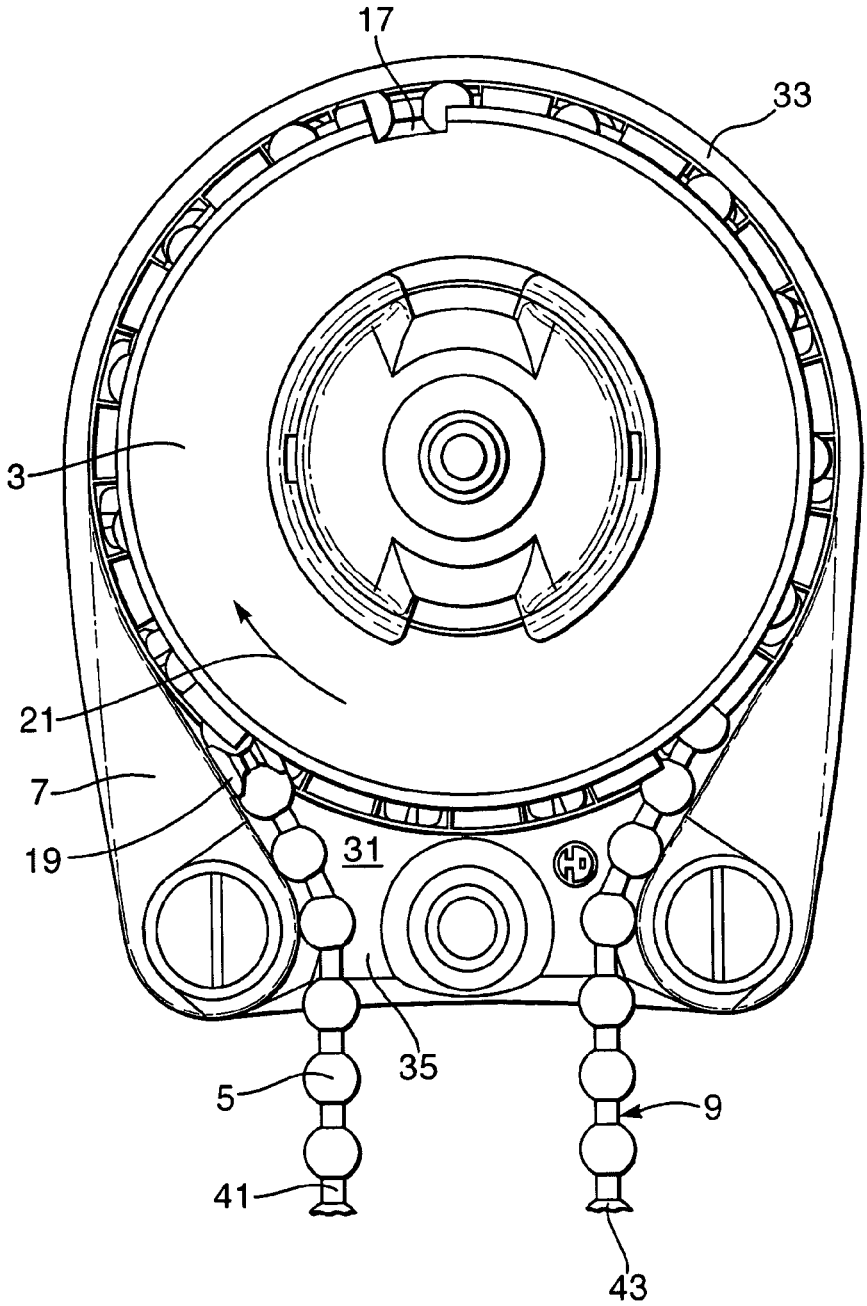
FIG. 2 is an enlarged view in accordance with FIG. 1, but showing a stopper engaged with the cover to inhibit further clockwise rotation.
Figure 2A:
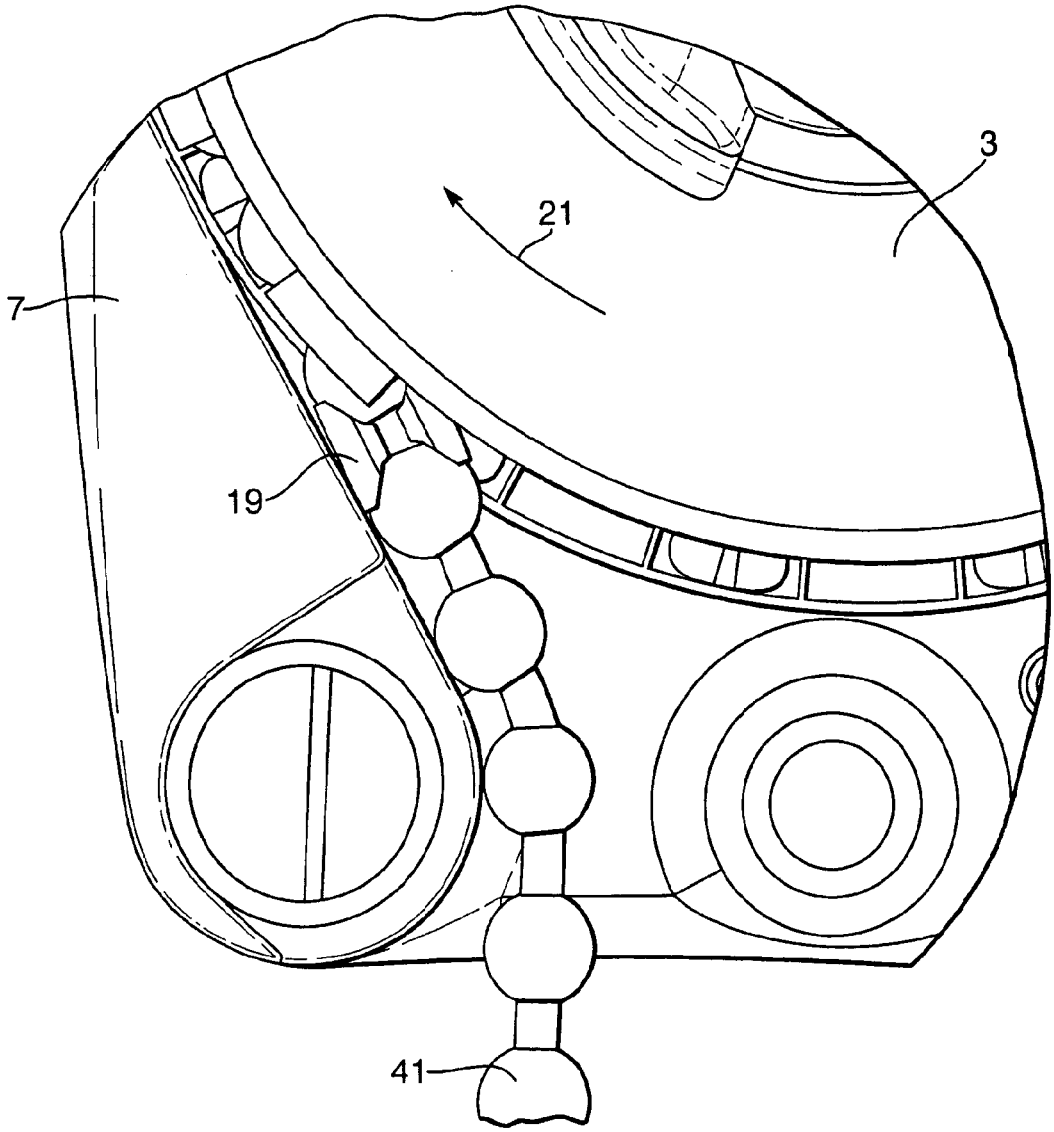
FIG. 2A is an enlarged detail of FIG. 2 showing in more detail the stopper in its engaged position.

FIG. 1 shows an operating system 1 according to the invention. This generally includes a drive pulley wheel 3 with a circumferential rim 5. Engaged with the wheel 3 and accommodated between the circumferential rim and a housing or cover 7 is a looped drive cord in the form of a ball chain 9. The pulley wheel 3 is operatively connected with a boss 11 to rotate the roller of a roller blind or some other winding device for a windable element of a window covering (not shown but conventional). Rotation of the pulley wheel 3 causes rotation of the boss 11, either directly or through a gear reduction as shown in, for instance, U.S. Pat. No. 6,685,592. In the illustrated example the pulley wheel 3 has an array of equally spaced pockets 13 (see FIG. 4) around its outer circumference 5 and the drive cord is in the form of a ball chain 9. Equally spaced balls 15 of the ball chain 9 fit into the spaced pockets 13 around the outer circumference 5 of the pulley wheel 3. Further the pulley wheel 3 in all the unindexed Figure numbers is shown to have an additional enlarged pocket 17 on its outer circumference 5 for accommodating a stopper 19. As illustrated in FIGS. 2 and 2A the stopper 19, when not accommodated in the pocket 17 will interfere with the housing 7 and thereby stop further rotation of the pulley wheel 3 in a clockwise direction, as indicated by arrow 21.

Figure 3:
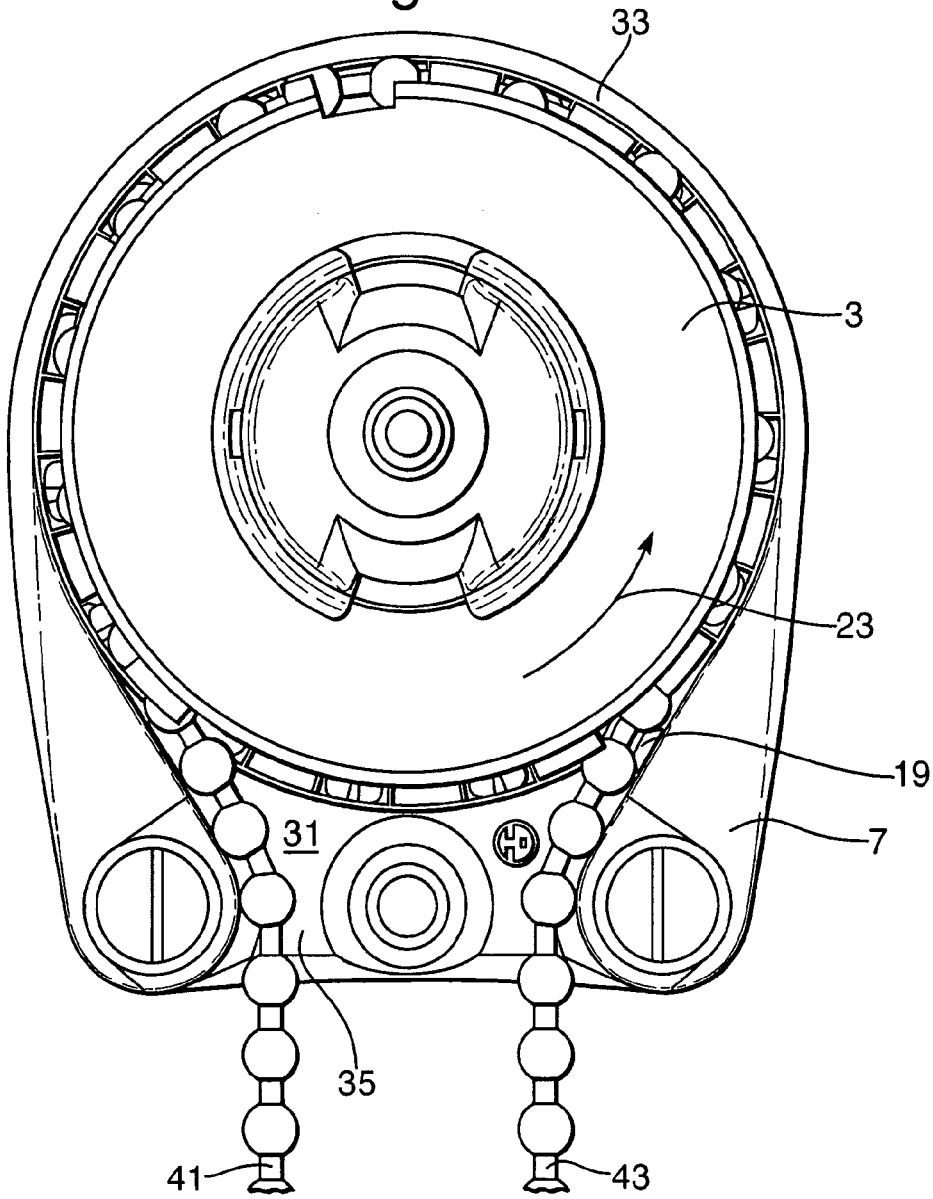
FIG. 3 is an enlarged view in accordance with FIG. 1, but showing the claim stopper engaged with the cover in a position to inhibit further anti-clockwise rotation.
Figure 3A:
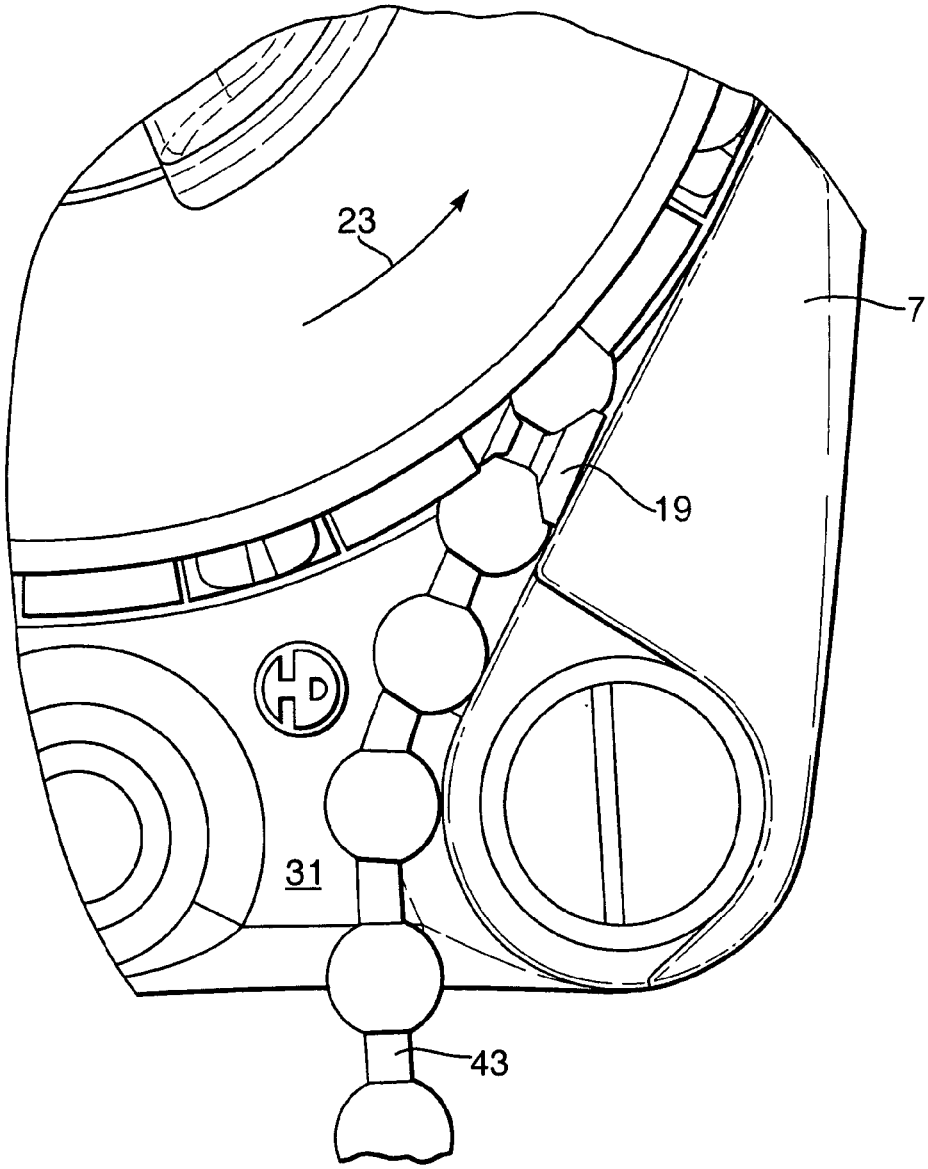
FIG. 3A is an enlarged detail of FIG. 3 showing in more detail the stopper in its engaged position.

FIGS. 3 and 3A illustrate the stop position in the anticlockwise direction, indicated by arrow 23, when the stopper 19 engages an opposite site of the housing 7 for blocking rotation of pulley wheel 3. As further shown in FIGS. 1 to 3A, the housing or cover 7, similar to the prior art of EP1672164, has a base web 31 from which the pulley wheel 3 is rotatably supported. A circumferential flange 33 is co-extensive with a major portion of the circumference of the pulley wheel 3 to keep the ball chain 9 in engagement with the pockets 13 of the rim 5. The circumferential flange 33 of the housing 3 does not extend over a portion of the wheel circumference where it forms an exit 35 for depending first and second drive cord branches 41 and 43. By manually pulling one of the branches 41 or 43 the pulley wheel 3 can be rotated in either a clockwise or an anti-clockwise rotational direction. This rotation will be used for raising or lowering of an architectural covering. The base web 31 also preferably includes means for attaching the housing 7 to a mounting bracket (not shown, but conventional).

Figure 4:
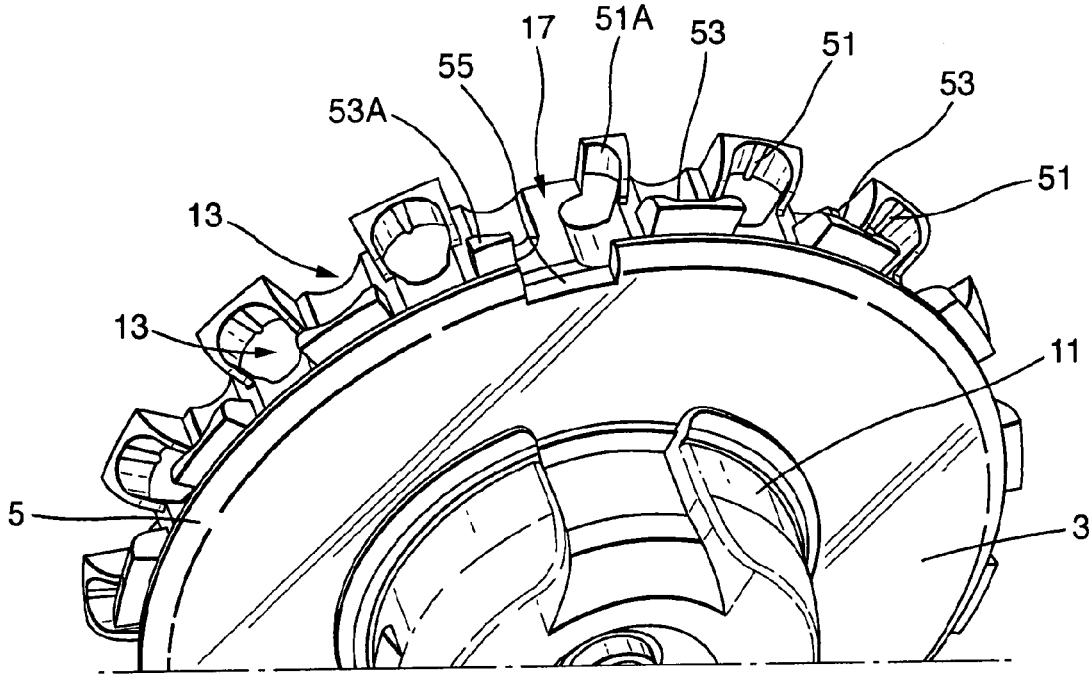
FIG. 4 is an enlarged perspective detail of the drive pulley wheel of the invention showing an additional cavity for accommodating the stopper.

As shown in FIG. 1 the operating cord or ball chain 9 can have a free hanging return loop 45 at its bottom end, or be held taught by a cord weight or other tensioning means, as described in EP1672164. As shown in FIG. 4 the pulley wheel 3 on its outer circumference 5 is provided with an array of alternating and oppositely directed cavities 51 and 53. This shape of the pockets 13 on the pulley wheel 3 with alternating first and second cavities 51 and 53 is not a functional requirement, but has merely been preferred in the interest of reducing the cost of injection molding of the pulley wheel. Other shapes of pulley wheels and circumferential pockets or teeth are possible and, indeed, in purview of the present invention. The basic requirement is only that individual formations, such as the pockets 13, are provided around the pulley wheel's circumference, which each accept only a single ball 15 of the ball chain 19. Because the stop positions of FIGS. 2, 2A, 3 and 3A are obtained by the stopper 19 being caught between successive pockets 13 (i.e. cavities 51, 53 or teeth formations separating the individual pockets) of the pulley wheel 3 and an inner surface of the flange 33, further rotation will be inhibited. However if the stopper 19 would coincide with the enlarged cavity or pocket 17 it will pass between the flange 33 and pulley wheel 3, without inhibiting rotation. In a situation where the number of balls 15 on the ball chain 9 would be a whole number multiple of the number of cavities 13 (i.e. cavities 51, 53) of the pulley wheel 3 then the stopper 19 would never provide a stop position and thus be ineffective to stop rotation. In contrast the invention proposes to chose the length of the ball chain 9 and its number of balls 15 not to be a whole number multiple of the number of pockets 13 around the pulley wheel 3. In this way an extra revolution of the entire chain length is obtained, before the stopper 19 becomes effective to stop further rotation in that direction. This allows the ball chain 9 to be made generally half the length as when required without the enlarged pocket 17.

To calculate the appropriate length of chain for use with a chain pulley wheel with a single enlarged pocket in combination with a roller blind, the following formula can be used:

$$x_{chain|Z\neq N} = p_c * \frac{1}{2}\left(\left(\frac{\sqrt{\frac{4 * l_f * t_f}{\pi} + d_t^2} - d_t}{2 * t_f} - n_{sa}\right) * i * p_{cw} + p_{cw} - x_{stop}\right)$$

Wherein:

$$Z = \frac{x_{chain}}{p_c * p_{cw}} \neq N$$

Z=ratio between chain length and chain pulley wheel circumference [ ]

N=natural whole number (1, 2, 3, . . . )

$X_{chain}$=length of the chain [mm]

$p_c$=pitch of the chain [mm]

$l_f$=length of the fabric [mm]

$t_f$=thickness of the fabric [mm]

$d_t$=outside diameter of the blind fabric winding tube [mm]

$n_{sa}$=number of additional safety windings of the fabric around the tube (360°=1) [ ]

i=gear transmission ratio from chain wheel to tube [1.75, 2.00, . . . ]

$p_{cw}$=number of pockets or teeth of the chain wheel [ ]

$x_{stop}$=number of non-engaged pockets or teeth of the chain wheel between the two stop positions along the outlet side [ ]

Figure 5:
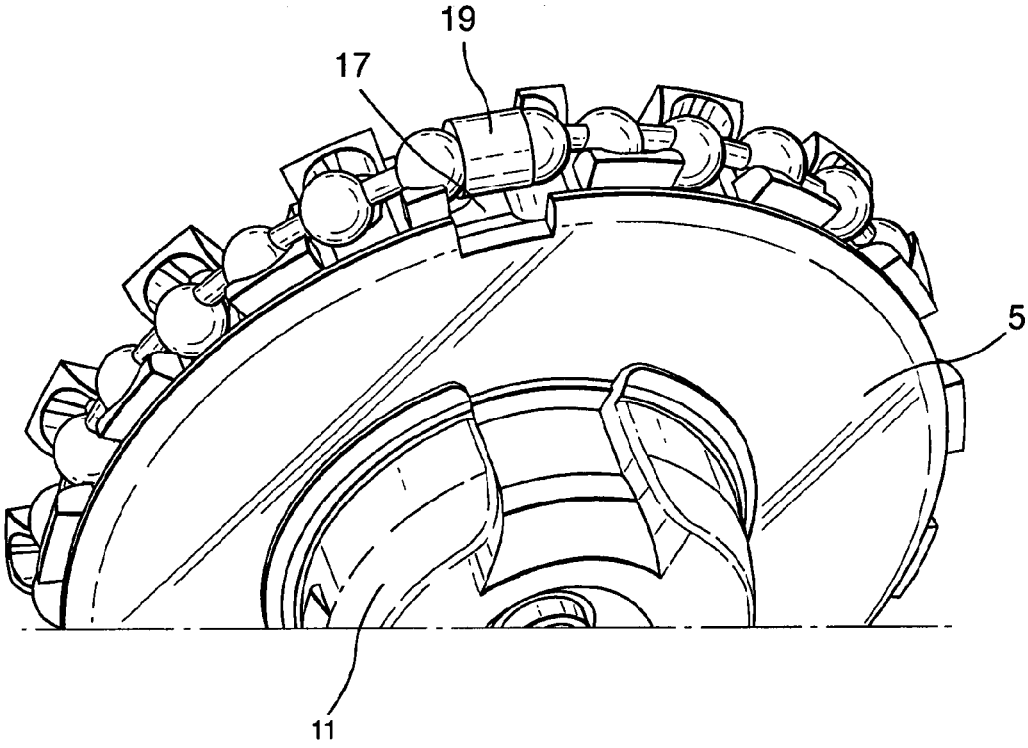
FIG. 5 is a perspective view similar to FIG. 4, but with the looped drive cord in position and the stopper received in an additional cavity.
Figure 6:
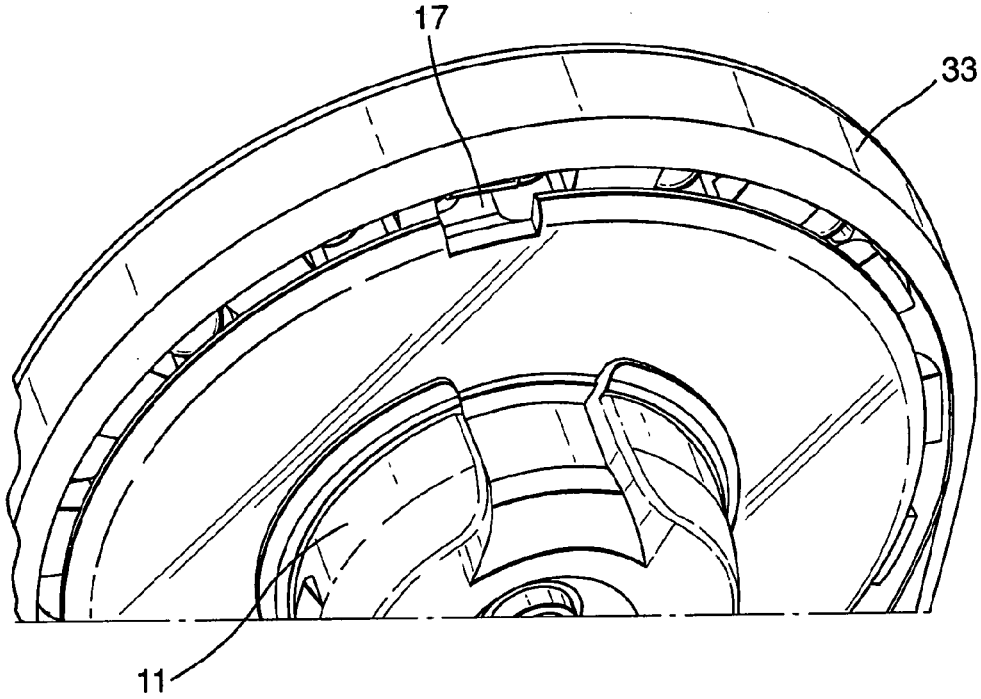
FIG. 6 is a perspective view similar to FIGS. 4 and 5, but now with the cover in shown in position over part of the pulley wheel's outer circumference.

The enlarged pocket 17, as shown in FIG. 4, can be obtained by removing part of the formations separating two adjacent pockets 13. The enlarged pocket 17 is delimited in the circumferential direction of the pulley wheel 3 only by a first remaining half cavity 51A and a second half cavity 53A. In-between these two half cavities there is obtained room to accommodate the stopper 19, which sits between two adjacent balls, in accordance with EP1672164 and as shown in FIG. 5. While the pulley wheel 3 can be manufactured with any number of enlarged pockets 17 around its circumference, subject to physical restrictions, it is also possible to create such an enlarged pocket 17 retrospectively in an existing conventional pulley wheel by punching away a portion of its circumference. For example a rectangular contoured punch tool may be employed to punch a contoured cut-out 55 in an axial direction of the pulley wheel 3 (see FIG. 4).

Furthermore the boss 11, may be shaped to be quickly engaged and disengaged with and from a winding device of an architectural covering. This enables an installer of a window covering to determine the end positions of the operating system and the architectural covering—such as a roller blind—separately and independently of one another. Once these end positions have been determined the architectural covering and the operating system may be simply connected by the boss 11, to correctly synchronise the end positions in respect of one another.

It is thus believed that the operation and construction of the present invention will be apparent from the foregoing description. The term comprising when used in this description or the appended claims should not be construed in an exclusive or exhaustive sense but rather in an inclusive sense. Expressions such as: "means for . . . ". should be read as: "component configured for . . . " or "member constructed to . . . " and should be construed to include equivalents for the structures disclosed. The use of expressions like: "critical", "preferred", "especially preferred" etc., is not intended to limit the invention. Features which are not specifically or explicitly described or claimed may be additionally included in the structure according to the present invention without deviating from its scope. The invention is further not limited to any embodiment herein described and, within the purview of the skilled person, modifications are possible which should be considered within the scope of the appended claims. Equally all kinematic inversions are to be considered within the scope of the present invention.

Directional references (e.g., upper, lower, upward, downward, left, right, leftward, rightward, top, bottom, above, below, vertical, horizontal, clockwise, or anti-clockwise) are only used for identification purposes to assist in the understanding of the present invention, and should not be construed to create limitations, as to position orientation, or use of the invention. Reference to either axially, radially or tangentially if used in the above is generally in relation to rotatable or cylindrical bodies of elements described. Where in the above reference is made to longitudinal or lateral this is in reference to the length or width directions respectively of elements which have an oblong or elongate appearance in the accompanying drawings.

The invention claimed is:

1. Operating system for rotatably controlling retraction and deployment of an architectural covering, the operating system including:

a drive pulley wheel having a circumferential rim;

a length of looped drive cord operatively engaged with the pulley wheel about its circumferential rim and having depending portions on opposite sides of the pulley wheel;

a cover co-extensive with a portion of the circumference of the pulley wheel; and at least one stopper attached to a portion of the length of the drive cord and adapted to engage the pulley wheel and the cover to stop rotation upon a predetermined amount of rotation of the pulley wheel, wherein the pulley wheel is provided with a cavity on its circumferential rim, for receiving the at least one stopper to prevent it from engaging the cover.

2. Operating system according to claim 1, wherein the drive pulley wheel is a sprocket wheel having a toothed circumferential rim.

3. Operating system according to claim 2, wherein the drive cord is a ball chain.

4. Operating system according to claim 1, wherein the cavity is formed by removing a portion of the circumferential rim.

5. Operating system according to claim 1, further including a reduction gearing driven by the pulley wheel.

6. Operating system according to claim 1, wherein the pulley wheel is operatively connected with a boss, adapted for being readily coupled to a winding device of an architectural covering for rotation thereof.

7. An operating system for an architectural covering, comprising:

a pulley wheel having a circumference and a cavity formed in the circumference;

a drive cord formed in a loop around the circumference of the pulley wheel and operative to rotate the pulley wheel, the drive cord having a length that is a non-whole number multiple of the circumference of the pulley wheel; and a stopper attached to the drive cord and receivable in the cavity, wherein when the stopper coincides with the cavity, the cavity accommodates the stopper without inhibiting rotation of the pulley wheel, and when the stopper does not coincide with the cavity, the cavity does not accommodate the stopper and the stopper inhibits rotation of the pulley wheel.

8. The operating system of claim 7, further comprising a flange co-extensive with a portion of the circumference of the pulley wheel, and wherein when the stopper coincides with the cavity, the stopper passes between the pulley wheel and the flange, and when the stopper does not coincide with the cavity, the stopper is caught between the pulley wheel and the flange.

9. The operating system of claim 7, wherein the drive cord includes a plurality of equally-spaced balls; and the pulley wheel includes a plurality of circumferentially-spaced pockets adapted to receive the plurality of equally-spaced balls.

10. The operating system of claim 9, wherein the cavity is formed by removing a portion of the pulley wheel between two successive pockets of the plurality of circumferentially-spaced pockets.

11. The operating system of claim 10, wherein the stopper resides between two successive balls of the plurality of equally-spaced balls.

12. An operating system for an architectural covering, comprising:

a pulley wheel having a plurality of circumferentially-spaced pockets, at least one pocket of the plurality of circumferentially-spaced pockets enlarged relative to a remainder of the plurality of circumferentially-spaced pockets;

a looped ball chain operatively engaged with the pulley wheel and including a plurality of balls that is a non-whole number multiple of the plurality of circumferentially-spaced pockets; and a stopper attached to the ball chain, wherein the at least one pocket is adapted to receive the stopper to permit rotation of the pulley wheel, and the remainder of the plurality of circumferentially-spaced pockets are adapted to not receive the stopper to inhibit rotation of the pulley wheel.

13. The operating system of claim 12, further comprising a housing co-extensive with a portion of a circumference of the pulley wheel.

14. The operating system of claim 13, wherein when the stopper aligns with the at least one pocket, the stopper passes between the pulley wheel and the housing without inhibiting rotation of the pulley wheel.

15. The operating system of claim 13, wherein when the stopper does not align with the at least one pocket, the stopper catches between the pulley wheel and the housing, inhibiting further rotation of the pulley wheel.

16. The operating system of claim 12, wherein the at least one pocket is formed by removing a portion of the pulley wheel separating two successive pockets of the plurality of circumferentially-spaced pockets.

17. The operating system of claim 12, wherein each of the remainder of the plurality of circumferentially-spaced pockets is adapted to accommodate a single ball of the plurality of balls.

18. The operating system of claim 12, wherein the at least one pocket is adapted to accommodate two successive balls of the plurality of balls.

19. The operating system of claim 12, wherein the stopper resides between two successive balls of the plurality of balls.

* * * * *

UNITED STATES PATENT AND TRADEMARK OFFICE

CERTIFICATE OF CORRECTION

PATENT NO. : 8,474,509 B2
APPLICATION NO. : 12/530025
DATED : July 2, 2013
INVENTOR(S) : Lars Koop It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 937 days.

Signed and Sealed this
Eighth Day of September, 2015

Michelle K. Lee

Michelle K. Lee
*Director of the United States Patent and Trademark Office*